US006805028B1

(12) United States Patent
Chang

(10) Patent No.: US 6,805,028 B1
(45) Date of Patent: Oct. 19, 2004

(54) REVERSIBLE RATCHET WRENCH

(76) Inventor: Jong-Shing Chang, No. 5, Chang Ma Street, Ma Hsing Village, Shiow Shoei Hsian, Chang Hua Hsien (TW)

( * ) Notice: Subject to any disclaimer, the term of this patent is extended or adjusted under 35 U.S.C. 154(b) by 0 days.

(21) Appl. No.: 10/726,598

(22) Filed: Dec. 4, 2003

(51) Int. Cl.[7] ..... B25B 13/46

(52) U.S. Cl. ..... 81/63.2; 81/60; 81/63; 192/38

(58) Field of Search ..... 81/63.6, 60, 63; 192/38, 45

(56) References Cited

U.S. PATENT DOCUMENTS 6,282,993 B1 * 9/2001 Forman et al. ..... 81/63.2

6,666,112 B2 * 12/2003 Hu ..... 81/63.1

* cited by examiner

*Primary Examiner*—Joseph J. Hail, III
*Assistant Examiner*—Alvin J Grant
(74) *Attorney, Agent, or Firm*—Bacon & Thomas PLLC

(57) ABSTRACT

A reversible ratchet wrench includes a wrench body having a head portion that has a hole and a chamber communicated with the hole. A ratchet wheel is rotatably mounted in the hole of the wrench body. A pawl is moveably received in the chamber of the wrench body and meshed with the ratchet wheel. An annular cover is rotatably mounted on the head portion of the wrench body for preventing the ratchet wheel from escaping out of the hole of the wrench body. The annular cover has a driving member contactable to the pawl for driving the pawl to move to a position where the ratchet wheel can be forced to turn clockwise or counterclockwise.

8 Claims, 5 Drawing Sheets

REVERSIBLE RATCHET WRENCH

BACKGROUND OF THE INVENTION

1. Field of the Invention

The present invention relates generally to a hand tool, and more particularly to a reversible ratchet wrench, which has an easier way of switching the wrenching orientation and has a simpler structure to reduce the cost of fabrication.

2. Description of the Related Art

FIG. 1 shows a conventional reversible ratchet wrench 1 having a handle 10 with a head portion 11 at an end thereof. The handle 10 is provided with a hole 12, a first chamber 13 and a second chamber 14 at the head portion 11, in which a ratchet wheel 20, a pawl 21 and a switch device 22 are respectively installed. The ratchet wheel 20 has a teeth portion 201 at an annular outer surface thereof and the pawl 21 has a teeth portion 211 at a front side thereof for detachably meshing the teeth portion 201 of the ratchet wheel 20. The pawl 21 makes the ratchet wheel 20 only turned along one orientation relative to the pawl 21. The pawl 21 has a recess 212 at a rear side thereof. The switch device 22 is provided with a slot 221, in which a spring 23 and a bullet 24 are installed. The bullet 24 is against the pawl 21 on a sidewall of the recess 212 thereof. The switch device 22 is switched to move the pawl 21, such that the ratchet wheel 20 is switched the wrenching orientation thereof.

FIG. 2 shows another conventional reversible ratchet wrench 2. The wrench 2 has two pawls 2A and 2B and a switch member 25 selectively engaged with one of the pawls 2A, 2B for changing the wrenching orientation of a ratchet wheel 26.

The conventional reversible wrenches are complicated in structure and the costs of fabrication are high. That is where the conventional reversible wrenches should be improved.

SUMMARY OF THE INVENTION

The primary objective of the present invention is to provide a reversible ratchet wrench, which is simpler in structure to reduce the cost of fabrication.

The secondary objective of the present invention is to provide a reversible ratchet wrench, which works easily and stably when switching the wrenching orientation of the ratchet wheel.

According to the objectives of the present invention, a reversible ratchet wrench comprises a wrench body having a head portion that has a hole and a chamber communicated with the hole. A ratchet wheel is rotatably mounted in the hole of the wrench body. A pawl is moveably received in the chamber of the wrench body and meshed with the ratchet wheel. An annular cover is rotatably mounted on the head portion of the wrench body for preventing the ratchet wheel from escaping out of the hole of the wrench body. The annular cover has a driving member contactable to the pawl for driving the pawl to move to a position where the ratchet wheel can be forced to turn clockwise or counterclockwise.

DETAILED DESCRIPTION OF THE INVENTION

Figure 1:
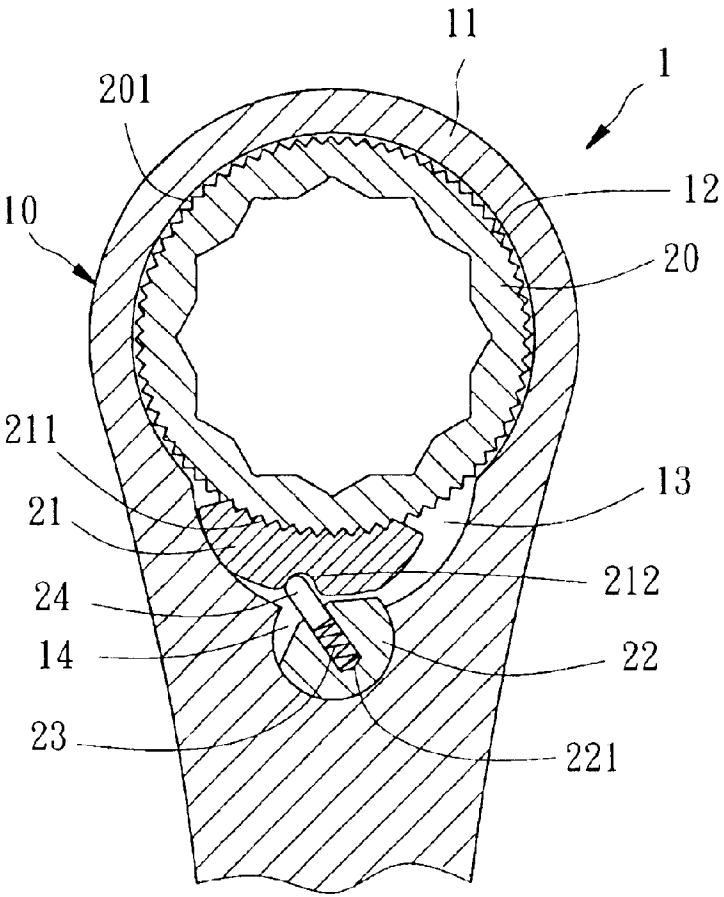
FIG. 1 PRIOR ART
FIG. 1 is a sectional view of a conventional reversible ratchet wrench.
Figure 2:
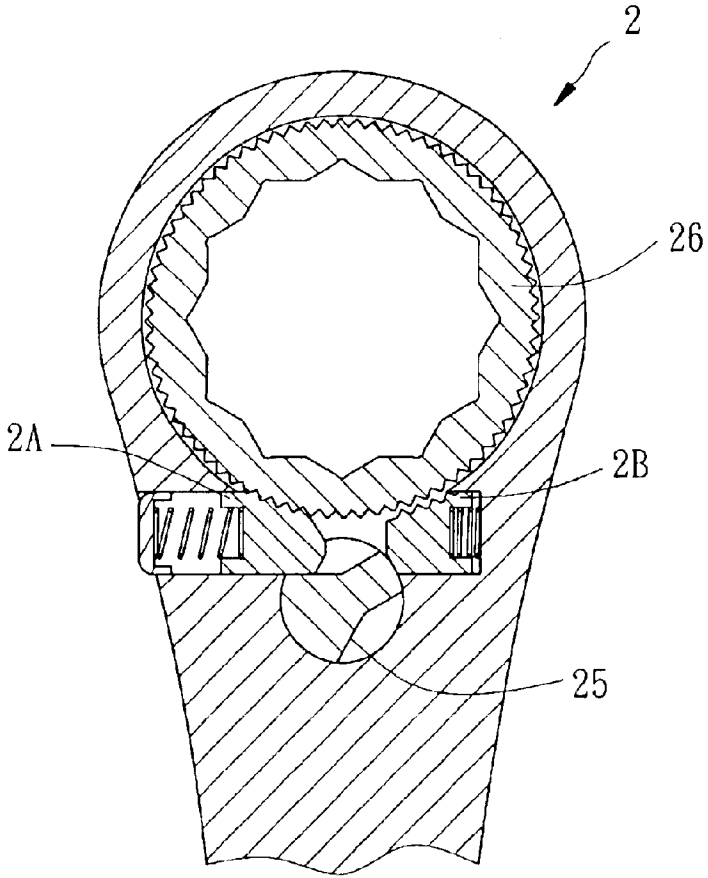
FIG. 2 PRIOR ART
FIG. 2 is a sectional view of another conventional reversible ratchet wrench.
Figure 3:
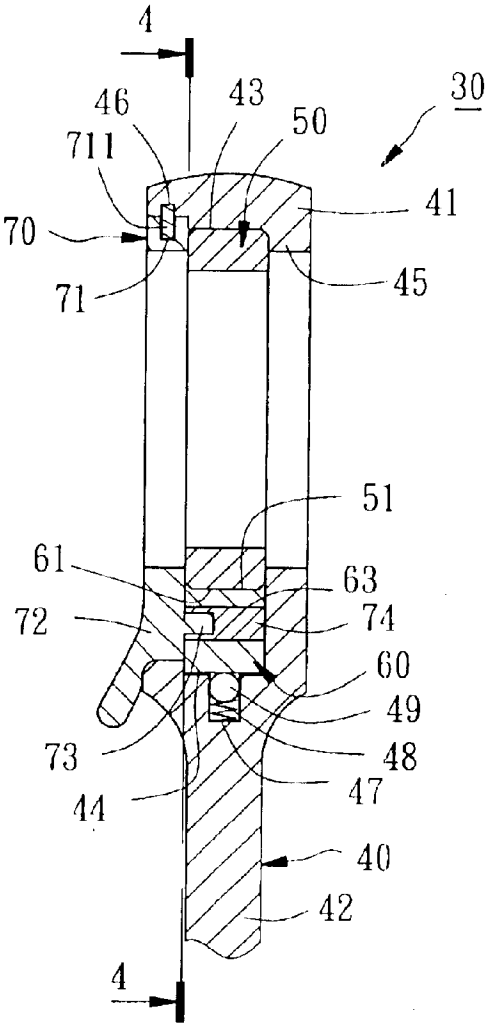
FIG. 3 is a lateral sectional view of a first preferred embodiment of the present invention.
Figure 4:
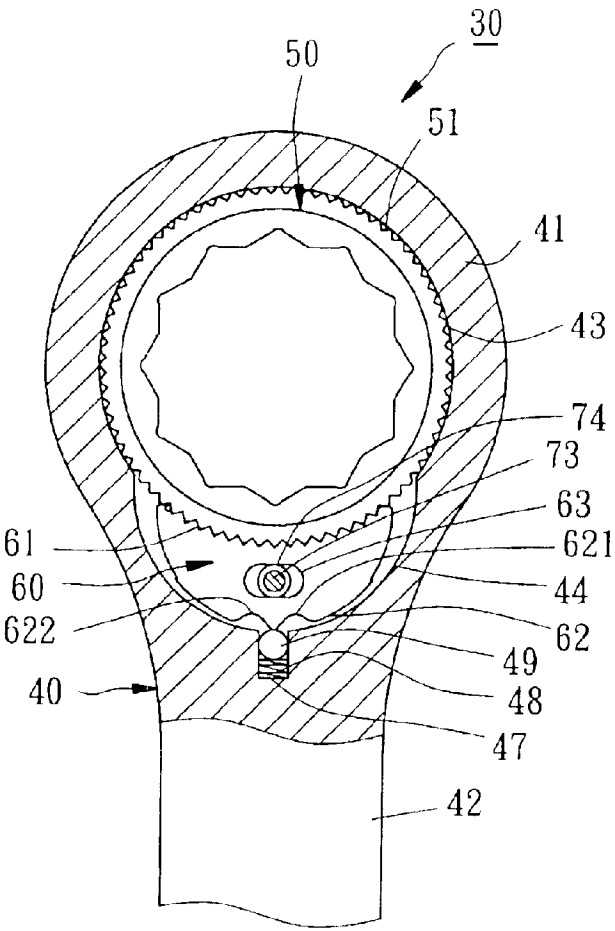
FIG. 4 is a sectional view taken along line 4—4 of FIG. 3.
Figure 5:
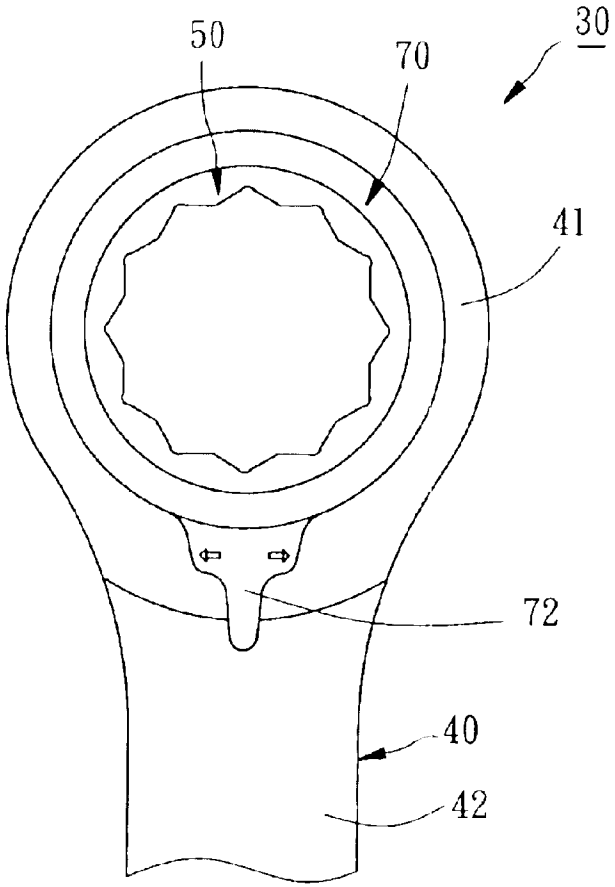
FIG. 5 is a front view of the first preferred embodiment of the present invention.

As shown in FIGS. 3–5, a reversible ratchet wrench 30 of the first preferred embodiment of the present invention comprises a wrench body 40, a ratchet wheel 50, a pawl 60 and an annular cover 70.

The wrench body 40 has a handle 42 and a head portion 41 at an end of the handle 42. The head portion 41 has a hole 43 and a chamber 44 communicated with the hole 43. On a sidewall of the hole 43 of the head portion 41 has an annular flange 45 at an end thereof and an annular recess 46 adjacent to the other end thereof.

The ratchet wheel 50 is mounted in the hole 43 of the head portion 41 for free rotation. The ratchet wheel 50 is in contact with the annular flange 45 to prevent it from escaping from the hole 43 via the side of the annular flange 45. The ratchet wheel 50 has a teeth portion 51 at an annular outer surface thereof The pawl 60 is slidably installed in the chamber 44. The pawl 60 is provided with a teeth portion 61 at a front side thereof for detachably meshing the teeth portion 51 of the ratchet wheel 50, and a driven portion 62 at a rear side thereof. The driven portion 62 has two recesses 621 and 622 arranged side by side. The pawl 60 is provided with an elongated slot 63 between the teeth portion 61 and the driven portion 62. On a sidewall of the chamber 44 has a slot 47 in which a spring 48 and a ball 49 is installed such that the ball 49 can be alternatively stopped at either the right recess 621 or the left recess 622 as shown in FIG. 6 or 7.

The annular cover 70 has an annular recess 71 on an outer surface thereof. A C-ring 711 is mounted both in the recesses 46 and 71 of the head portion 41 and the annular cover 70 to secure the annular cover 70 on the head portion 41 and the annular cover 70 can be rotated freely. The annular cover 70 has a trigger 72 and a driving member 73, which is a rod projected from a bottom of the trigger 72 and received in the elongated slot 63 of the pawl 60. The annular cover 70 is rotated by exerting the trigger 72 and the pawl 60 is moved to the right or the left of the chamber 44 via the driving member 73. A bushing 74 is fitted onto the driving member 73 to reduce the friction while the driving member 73 moves along the elongated slot 63.

Figure 6:
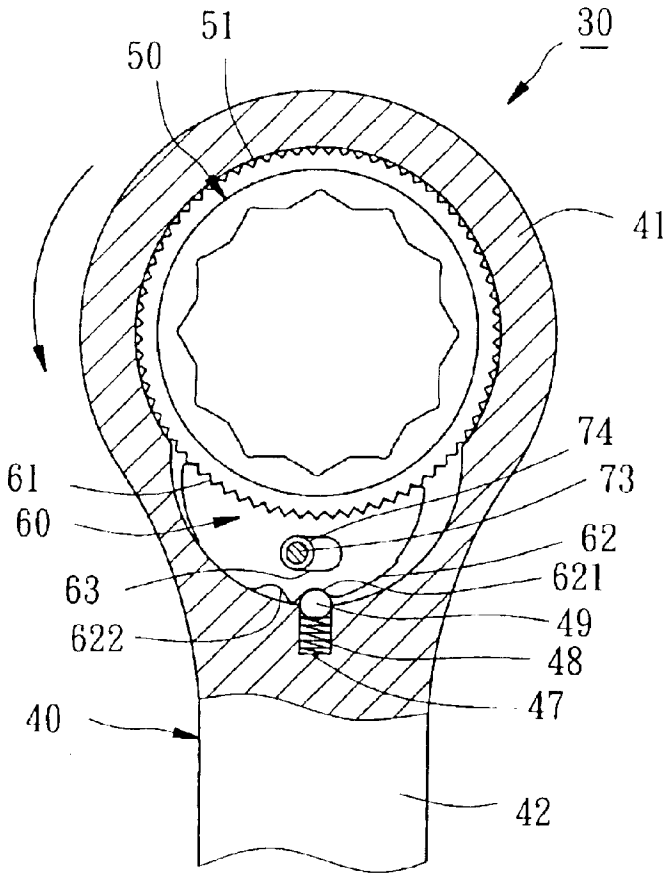
FIG. 6 is sectional view of the first preferred embodiment of the present invention, showing the ratchet wheel being switched to a wrench orientation.
Figure 7:
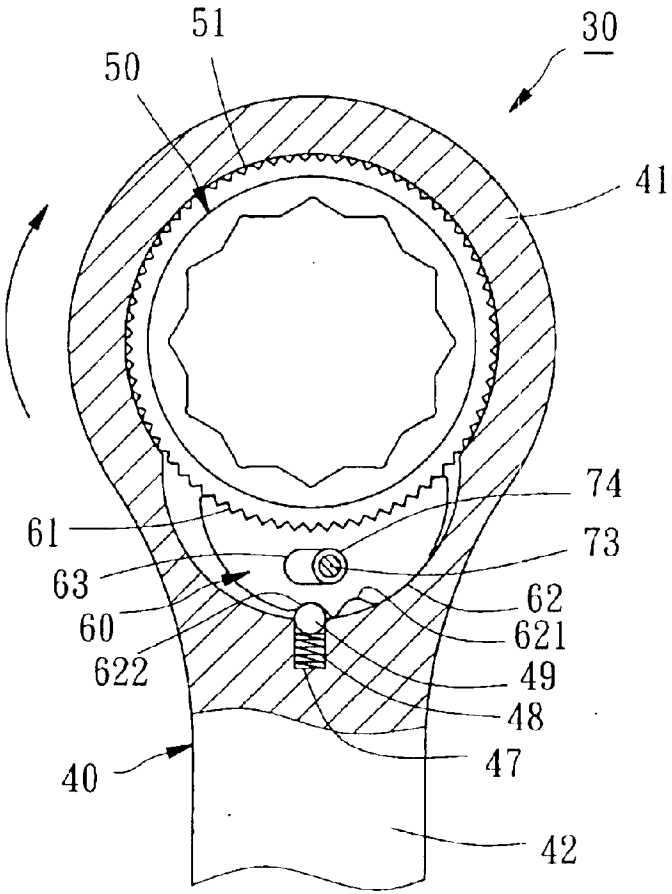
FIG. 7 is sectional view of the first preferred embodiment of the present invention, showing the ratchet wheel being switched to another wrench orientation.

As shown in FIG. 6, the trigger 72 is moved to left and the driving member 73 is moved to a left end of the elongated slot 63 and forces the pawl 60 to the left of the chamber 44. The ball 49 is moved to the right recess 621 of the driven portion 62 to hold the pawl 60 at the present position such that the ratchet wheel 50 can only be turned counterclockwise. Similarly, the trigger 72 also can be moved to right and the pawl 60, therefore, is moved to the right of the chamber 44 as shown in FIG. 7, causing the ball 49 being moved to the left recess 622 of the driven portion 62 such that the ratchet wheel 50 can only be turned clockwise.

As described above, the switching structure of the present invention is simpler than that of the conventional reversible ratchet wrench. The number of the components of the present invention is fewer than the prior art, so that the reversible ratchet wrench of the present invention has a simpler structure and a lower cost of fabrication. The way of switching the wrenching orientation is fast and easy.

Figure 8:
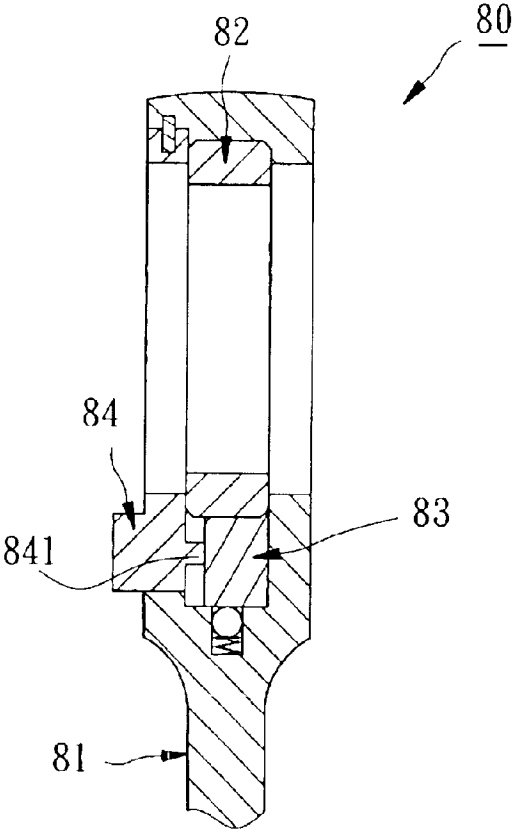
FIG. 8 is a lateral sectional of a second preferred embodiment of the present invention.
Figure 9:
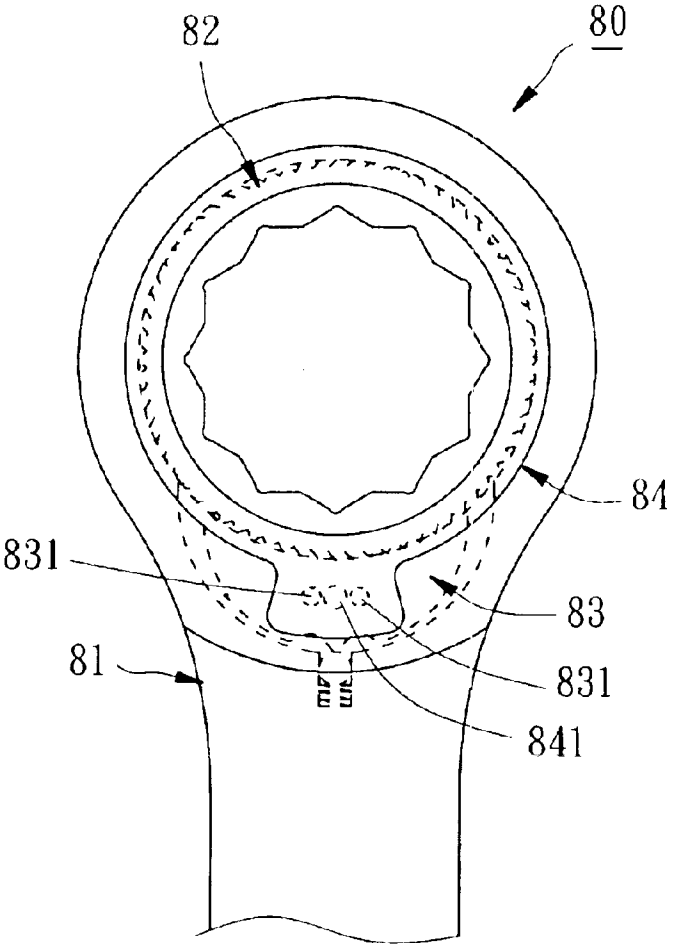
FIG. 9 is a front view of the second preferred embodiment of the present invention.

As shown in FIG. 8 and FIG. 9, a reversible ratchet wrench 80 of the second preferred embodiment of the present invention, which is similar to the reversible ratchet wrench 30 of the first preferred embodiment, comprises a wrench body 81, a ratchet wheel 82, a pawl 83 and an annular cover 84. The pawl 83 has two upright posts 831 at a top thereof and between which is disposed a driving member 841 of the annular cover 84. The driving member 841 can drive the pawl to slide by contacting and pushing one of the upright posts 831.

Figure 10:
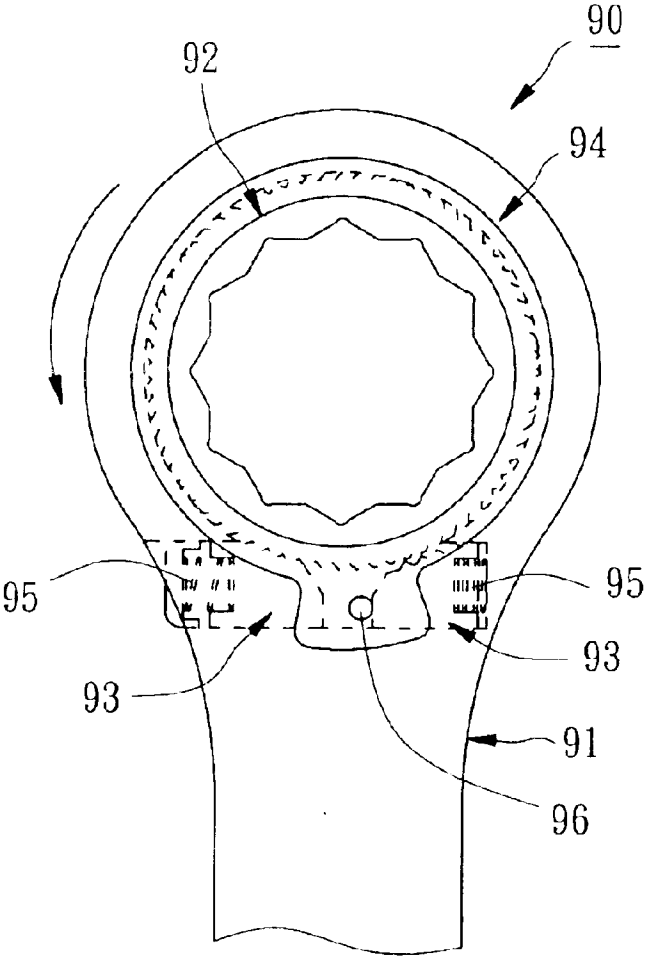
FIG. 10 is a front view of a third preferred embodiment of the present invention.

The features of the present invention also can be applied to a ratchet wrench with two pawls as described in the background of the invention. As shown in FIG. 10, a reversible ratchet wrench 90 of the third preferred embodiment of the present invention comprises a wrench body 91, a ratchet wheel 92, two pawls 93 and an annular cover 94. Two springs 95 are respectively disposed between the respective pawl and the side wall of the chamber of the wrench body. The annular cover 94 is provided with a driving member 96 rested between the pawls 96. Whereby, user switches the annular cover 94 to drive the driving member 96 moving one of the pawls 93, thereby causing that the ratchet wheel 50 can only be turned along one direction, clockwise or counterclockwise.

It has to be mentioned that the way and structure of how the driving member moves the pawl(s) should not be limited only in the description and drawings of the present specification. Any equivalent structure that serves the function of the driving member moving the pawl(s) should be within the scope of the present invention.

The advantages of the present invention are that the structure is simple; cost of the fabrication is low and it is easy to be operated.

What is claimed is:

1. A reversible ratchet wrench, comprising:

a wrench body having a handle and a head portion at an end of the handle, said head portion having a hole and a chamber communicated with the hole;

a ratchet wheel rotatably mounted in the hole of the wrench body and having an annular teeth portion at an outer surface thereof;

a pawl moveably received in the chamber of the wrench body and having a teeth portion for meshing the teeth portion of the ratchet wheel, and an annular cover rotatably mounted on the head portion of the wrench body for preventing said ratchet wheel from escaping out of the hole of the wrench body, wherein the annular cover has a driving member contactable to the pawl for driving the pawl to move to a position where the ratchet wheel can be forced to turn clockwise or counterclockwise.

2. The reversible ratchet wrench as defined in claim 1, wherein said driving member of the annular cover is a rod and said pawl has an elongated slot for receiving the driving member.

3. The reversible ratchet wrench as defined in claim 2, further comprising a bushing fitted onto the rod.

4. The reversible ratchet wrench as defined in claim 1, wherein the pawl is provided with two posts and the driving member of the annular cover is a rod rested between the posts.

5. The reversible ratchet wrench as defined in claim 1, wherein the pawl is provided with a driven portion at a side opposite to the teeth portion, wherein the driven portion has two recesses, and the wrench body is provided with a slot at a sidewall of the chamber, in which a spring is installed, said spring having an end against the driven portion.

6. The reversible ratchet wrench as defined in claim 1, wherein the pawl is provided with a driven portion at a side opposite to the teeth portion, wherein the driven portion has two recesses, and the wrench body is provided with a slot at a sidewall of the chamber, in which a spring and a ball are installed, wherein the ball pushes the driven portion by the spring.

7. The reversible ratchet wrench as defined in claim 1, further comprising another pawl received in the chamber, wherein the driving member of the annular cover is a rod rested between the pawls.

8. The reversible ratchet wrench as defined in claim 7, further comprising two springs respectively disposed between the respective pawl and the wrench body.

* * * * *